US005630304A

United States Patent [19]

Austin

[11] Patent Number: 5,630,304

[45] Date of Patent: May 20, 1997

[54] ADJUSTABLE INTERLOCK FLOOR TILE

[76] Inventor: John Austin, 899 El Centro, South Pasadena, Calif. 91030

[21] Appl. No.: 703,366

[22] Filed: Aug. 26, 1996

Related U.S. Application Data

[63] Continuation of Ser. No. 579,233, Dec. 28, 1995.

[51] Int. Cl.[6] ..... E04F 13/08

[52] U.S. Cl. ..... 52/384; 52/590.2; 52/592.1

[58] Field of Search ..... 52/177, 179, 180, 52/590.1, 590.2, 591.1, 591.2, 591.3, 592.1, 506.01, 589.1, 591.4, 592.2, 98, 384, 387; 404/35, 36

[56] References Cited

U.S. PATENT DOCUMENTS

| | | | |
|---|---|---|---|
| 3,802,144 | 4/1974 | Spica | 52/591 |
| 4,003,172 | 1/1977 | Pawl | 52/279 |
| 4,226,064 | 10/1980 | Kraayenhof | 52/180 |
| 4,287,693 | 9/1981 | Collette | 52/177 |
| 4,361,614 | 11/1982 | Moffitt, Jr. | 428/138 |
| 4,468,910 | 9/1984 | Morrison | 52/591 |
| 4,497,858 | 2/1985 | Dupont et al. | 428/44 |

*Primary Examiner*—Creighton Smith
*Attorney, Agent, or Firm*—John F. Sicotte

[57] ABSTRACT

A quadrilateral floor tile is provided with a generally flat top surface with each side having a downward sloping edge, inclining toward the floor. Two of the sides, being adjacent, are formed with an integral interlocking strips, each having a plurality of spaced-apart male connecting members. The remaining sides of the tile are formed with a plurality of cavities located to the interior to the sloping edge. Each of the cavities is positioned to mate with a corresponding male connecting member of a neighboring tile. In use, the tiles are interlocked with a number of like tiles to form a basic floor surface. When the outer periphery of the floor surface is encountered, a finished tile edge is formed on perimeter tiles by severing the interlock strip from each tile. The length of each interlock strip may also be adjusted to interlock only at points of intersection with neighboring tiles or may be removed entirely to form a smooth edge.

3 Claims, 3 Drawing Sheets

ADJUSTABLE INTERLOCK FLOOR TILE

CROSS REFERENCE TO RELATED APPLICATIONS

This application is a continuation of my pending application Ser. No. 579,233, filed Dec. 28, 1995, now pending.

BACKGROUND OF THE INVENTION

This invention is related to a rectangular interconnecting modular floor tiles, which have at least two male interlocking stripsand two female interconnecting strips. Such tiles are normally used as field tiles in a floor covering for an entire room. Other types of related tiles are stand alone tiles which act as floor mats. Such tiles do not need interlocks but often have sloping edges for safety and appearance. Finally there are tiles which are used as components in a runner type mat. these tiles have interlocking edges and supplemental edge pieces to finish the perimeter of the mat, as needed to fit a variety of circumstances.

DESCRIPTION OF THE RELATED ART

Floor tiles are most often used as modular components in the construction of a complete flooring system. The system may be designed as a floor covering for an entire room or it may be a runner mat which may be removed for cleaning, such as hallway runners. The system could also serve as a combination of a floor covering for an entire room, which is interconnected with any adjacent rooms and hallways. Floor tiles to be used as a component for either design of floor covering normally have a rectangular shape. The tile will have two adjacent sides having interlocks in the form of projecting fingers or male elements. The remaining two sides of each tile have matching cavities which are designed to mate with the projecting elements. Tiles, which act as basic interlocking modular units, are identical to one. When the outside perimeter of the flooring area is encountered a modified tile must be used to produce a smooth and finished edge. Whether the system involves the forming of a passageway runner or a room covering, then once the basic mat is formed, there will be a line of tiles along one side which have a plurality projecting male elements which remain unused and thus exposed. In the interests of safety and the sake of appearances these projecting elements must be covered. One method is to not use the basic tile but to use special tiles which are made without interlocking strips and which have a sloping edge. Another method has been to add a supplemental edge strip which has been designed to mate with the projecting elements of a basic tile. Some such strips are very narrow and have a sloping outside edge. The objectives of either the special tiles or the supplemental edge strips are to give the flooring a finished appearance while preventing a person from accidentally tripping on any unused interlock projections. One example of this type of solution to the problem was suggested by Dupont, U.S. Pat. No. 4,497,858 whose primary objective was to provide a water retaining entrance mat. The mat was designed to be composed of several identical basic tiles which were then finished with edging strips about its outer perimeter. An "L" shaped edging strip was installed on the top lefthand corner of the basic mat. The strip had female connecting means on its inner side. These means interconnected with male connecting means formed in the mat. Straight edging strips were installed on the top side of the mat having male connecting means and straight edging strips having female connecting means were installed on the left side of the basic mat. In addition, all of the strips had ends which interlocked.

Presumably, an "L" shaped outside corner strip would also be needed on the right corner of the basic mat. Also, if the mat intersected another mat to form a "T", then inside right angle corners would be needed to finish the mat. It should be noted that the edging strip disclosed by Dupont et al is beveled for safety. A beveled, rounded or tapered edge is particularity needed in areas where the mat is first encountered, such as entrances to passageways and doorways.

While mats such as the Dupont mat do resolve issues of safety and appearance with edging strips; they do so at the expense of simplicity and expense. A designer of a floor or passageway runner must calculate the amount of regular tiles which are going to be required. In addition a calculation must be made the amount and type of each kind of edging strip that are going to be required. This adds time needed to make the calculation and time required to purchase the proper strips. The costs of the strips are also going to add to the expense in that such items are not as efficiently produced as the tiles, which are made in high volume. Unexpected expenses can occur if the designer is mistaken as to the required number, the supplier does not have sufficient quantities of each type, or the installer forgets to bring or ruins some of the strip pieces.

It is the objective of the present invention to provide a floor tile which may be used as modular unit to form a floor covering of any size and shape using edges which will cooperatively interlock with any other tile of the invention.

It is another objective of this invention to provide a tile which can be modified to produce a safe and finished edge without the addition of any supplemental edging pieces, regardless of whether the edge is along the side of finished floor covering, or a passageway runner, or a runner which is "L" shaped, or a runner which must "T" into a floor covering.

It is yet objective of this invention is to provide a complete floor tiling system that requires a supplier to stock only one type of tile and no supplemental edging pieces.

It is still another objective of this invention is to provide a complete floor tiling system which requires only minimum training and planning to install.

A further objective of the invention is to provide an extremely flexible flooring system that can be configured to meet the requirements of complex floor plans, which involve many intersecting passageways and associated rooms.

In accordance with present invention, a square or rectangularly shaped tile is provided, which has two adjacent sides with an integral strip having a plurality of male means. The two remaining sides of the tile have a corresponding number of female connecting means in the form of cavities which are designed to cooperatively interlock with the male connecting means. All four sides of the tile have an outside edge which is beveled or rounded. In order to form a floor covering or a passageway runner, each such is interlocked with another like tile. When a portion of the floor covering that is an outside edge is encountered, the edge of the tile with the female connecting means will form a continuous beveled edge. If the outside edge contains exposed male connecting means, the edge is easily modified by removing the connecting means with a utility knife, thereby forming another continuous beveled edge.

The present invention overcomes the problems associated with modular floor tiles of the prior art by providing a tile that does not need supplemental edging strips in areas where the edges of the tile will be exposed. Additionally, the present invention provides a one tile flooring system that reduces production and inventory costs, that requires minimal training and planning and that is extremely flexible in adapting to the requirements of complex floor plans.

SUMMARY OF THE PRESENT INVENTION

The present invention provides a single tile system which may be used as a stand alone mat, a field tile in a floor covering or a modular component in a runner mat without the need for any additional special tiles or supplemental edge pieces. The preferred embodiment of the invention is a rectangular tile with four sides which have beveled edges. The floor tile constructed in accord with the invention has two adjacent sides with adjustable interlocking strips. These strips allow another like tile to be interlocked at almost any desired point along the interlocking strip or two adjoining strips. Upon completion of the main floor covering and any intersecting runners such construction permits the finishing of the floor covering by trimming off any unused portions of the interlocking strips. If a stand alone mat is desired, the interlocking strips are simply removed. In either instance the preferred embodiment provides a mat which is safe and has a finished appearance without the need for any special tiles or supplemental pieces. These and other features, objects and advantages of the present invention can be best understood by reference to the accompanying drawings, and appended claims.

DETAILED DESCRIPTION OF THE PREFERRED EMBODIMENT

Figure 1:
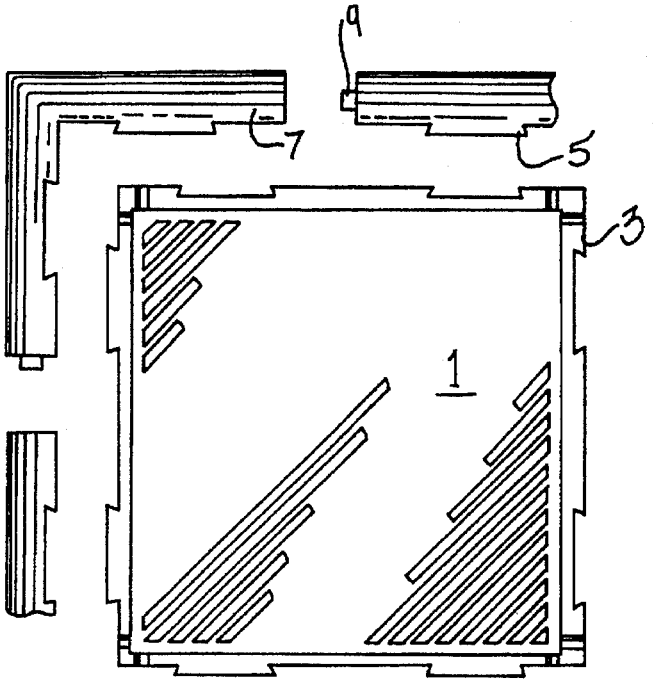
PRIOR ART FIG. 1
FIG. 1 is a top view of a prior art floor tile with supplemental edging pieces.

Referring initially to FIG. 1, there is shown a prior art floor tile 1 which has been constructed in accord with the teachings of the Dupont U.S. Pat. No. 4,497,858. In general, the outside edges of an entrance mat are designed to permit a person to make a safe transition from a lower floor surface to the mat. Normally, this accomplished by providing the edge with a sloping or inclining surface so as to prevent a person from tripping. The mat disclosed in the Dupont patent is constructed of tile 1 that has edges 3 which are vertical to a floor surface. Once mat 1 has been constructed it is then finished with supplemental edges which interlock with any remaining exposed interlocks of the mat. The left outside corner is protected by edge 5 and the remaining spaces are filled by edges 7. Each of the edge pieces if also interlocked with one another by a stud 9 which fits into an associated cavity in an adjacent piece. The Dupont mat is typical of floor mats which have been constructed of interlocking tiles which then are modified with supplemental pieces around their perimeter to provide for a safe and nice appearing finished product. It should be noted, however, that such prior art flooring systems are somewhat inflexible and complicated. An installer of such a system in a work area which involves various intersecting passageways with numerous door openings is faced with a formidable task. For example, when a passageway mat meets another passageway mat, creating a "T" shape, the points of connection is limited. According to Dupont the mat can only be interlocked at one-half tile intervals, i.e. the mat intersecting mat must be either directly aligned or aligned on the center of two mats.

Further, the prior art mats require that a supplier of such mats stock an inventory of the supplemental pieces to be used for the edging. The Dupont example would require an inventory of at least six different types of edges: two types of straight edges, a left outside corner, a right outside corner, a left inside corner, and a right inside corner. It should also be noted the edge pieces cannot be readily adjusted as to their length since they are made to interlock together. In addition, the Dupont edge pieces must be first interlocked with each other prior to their combined installation. The installer must not only be very skillful and experienced, but must also be a careful estimator of the exact quantities of each type of edging that will be needed. Even more problematic are doorways along a passageway. Door openings seldom align themselves perfectly with the dimensions of a floor tile. Since tiles like the one in Dupont are designed to interlock at one-half tile intervals, the branch that a mat makes into a room will oftentimes be misaligned with the door opening and look awkward.

The alternative to the modular type of tile that is modified with supplemental edgings is simply to have a basic field tile and a large variety of special tiles. Such tiles would have an interlocking edge for connection to the field tile and sloping edges at various points to meet special needs. For example, a tile at the entrance to a passageway would need a sloping edge on the side opposite the interlocking edge. The tile may also need to have sloping edges on its remaining sides, if it forms a part of a runner type mat. It can be easily understood that a supplier would need to maintain an inventory of a multitude of special tiles to cover most situations. It was precisely this sort of problem which the Dupont was designed to alleviate with the supplemental edging approach. The only real difference, however, is that the item to be maintained in inventory is smaller, but the number of different types remains the same.

Figure 2:
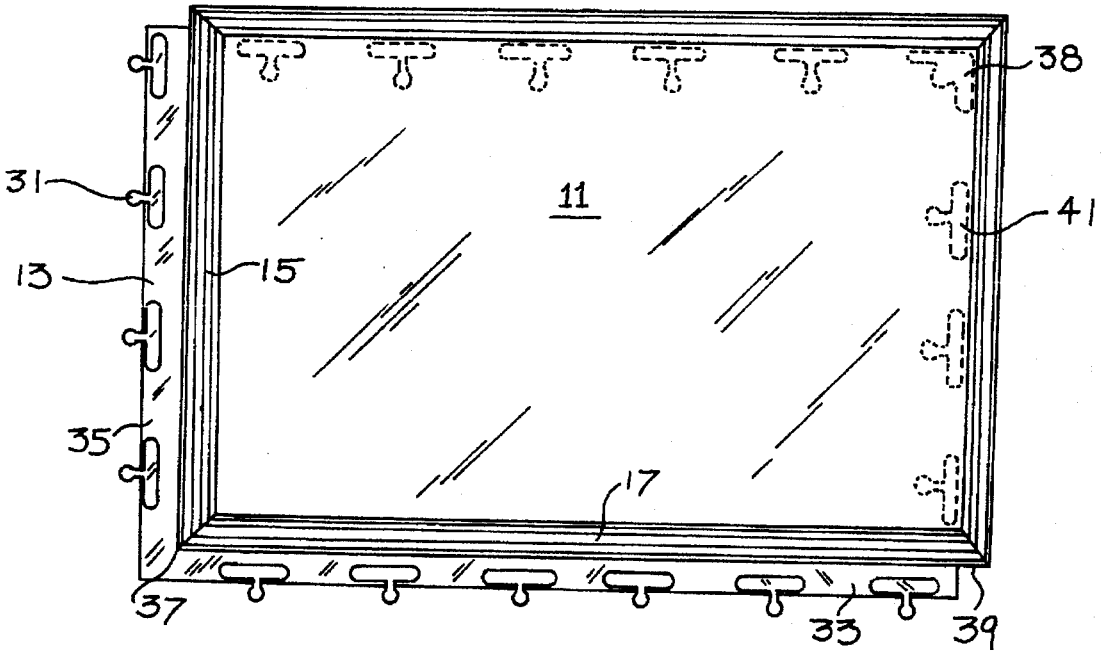
FIG. 2 is a top view of the preferred embodiment of the invention, which is unmodified.

FIG. 2 shows a single tile 11 of the present invention which overcomes the limitations of the prior art. As shown in FIG. 2, tile 11 is a complete and unmodified rectangularly shaped tile which would act as a basic tile. The tile is formed as an integral structure from a rubber compound which is composed of either natural and synthetic rubbers. The preferred embodiment tile shown in FIG. 2 has length of two feet and a width of three feet from bevel edge to bevel edge. Along each side of the tile there is illustrated a plurality of connecting means, either a male connecting member 31 or a female cavity 41. For the purpose of clarity the number of the connecting means have been reduced. In actuality, the preferred embodiment has 25 connecting means along the length of the tile and 19 connecting means along the width of the tile. Each of the connecting means is spaced apart from a neighboring connecting means by approximately 29 mm or one and one-eighth inches when measured from center to center. Male connecting member 31 is integrally molded with strip 13 along with the remainder of the preferred embodiment. Strip 13 is about 1.5 mm in thickness, forming a continuous support structure for the male connecting members and having a long portion 33 along beveled edge 17 and a short portion 35 along beveled edge 15 of the preferred embodiment. As shown in FIG. 2, the preferred embodiment is in the form to be used as a field tile. In the construction of a mat, the tile is unmodified and is interconnected in the usual manner with other like tiles to form a larger mat. At reference numeral 38 a special female cavity has been formed. It is a dual purpose receptacle designed to receive a male connecting member from either of the adjacent sides of the tile. A similar cavity is shown in use in FIG. 3, wherein the edge of a tile is interlocked along one edge.

The same tile shown in FIG. 2 may easily be modified to form a stand alone mat. To modify the tile an installer can remove both long portion 33 and short portion 35 by severing strip 13. By running the blade of a common utility knife, or other suitable tool known in the art, along beveled edge 15 at the point where strip 13 joins with the base 37 of beveled edge 39. The same operation is performed along the base of the adjacent beveled edge 39. The result of the modification is a stand alone mat with four identical sides, each side having a beveled edge with a finished appearance.

Figure 3:
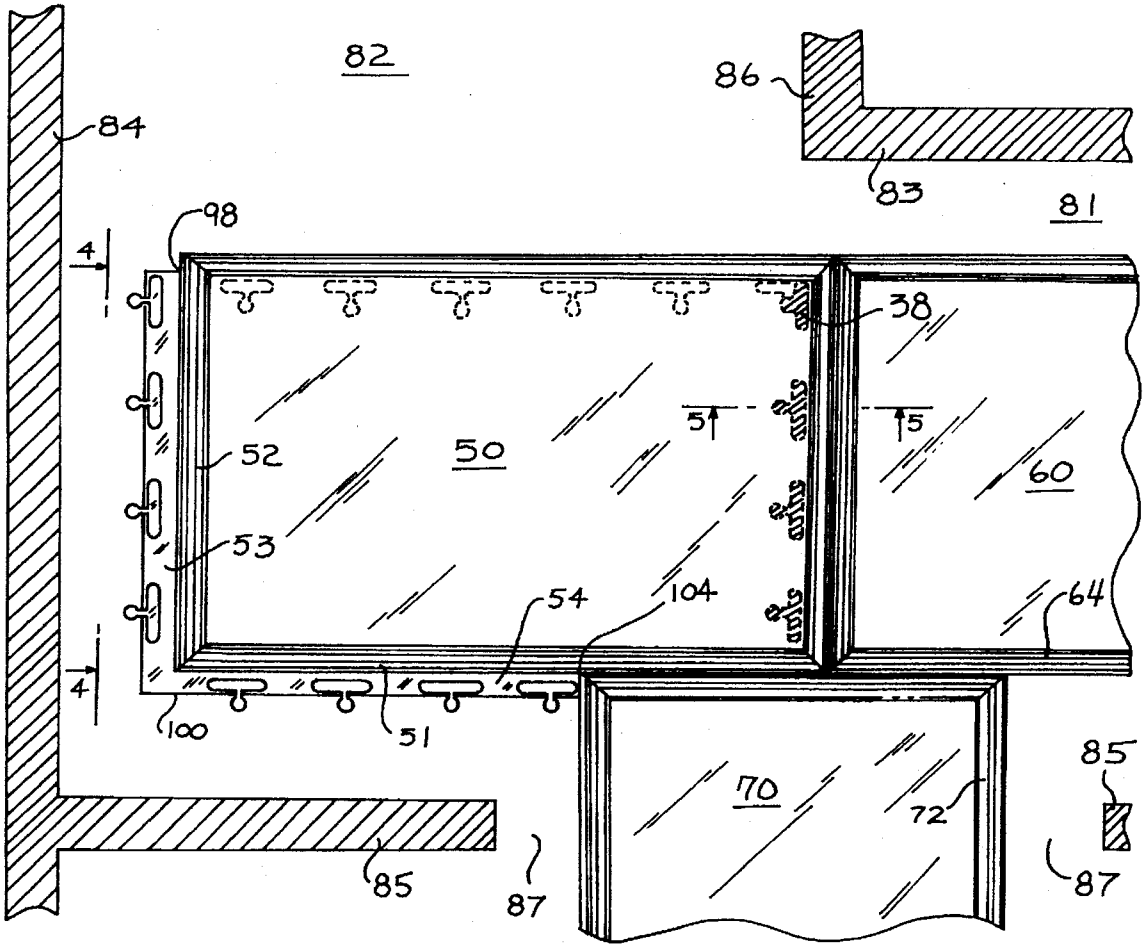
FIG. 3 is a top view of a runner mat comprised of an unmodified tile according to the invention interlocked with two modified tiles shown in a partial view.

Referring now to FIG. 3, there shown three tiles 50, 60 and 70, each of which been constructed according to the invention. Tile 50 and tile 60 have been interlocked together to form a passageway runner mat with tile 70 forming a "T" branch. It should be noted that runner mat might be only a portion of a large system of tiles forming numerous runners which can intersect other like runners coming at right angles from other passageways. The system might also include many branches, such as tile 70, which provide a pathway into rooms that are off the passageway. In practice, an installer, given the floorplan of an area to be covered, need only to make a simple layout pattern of the grid of runners and branches involved and order a sufficient number of tiles. Note that the installer does not need to take in consideration the various kinds of tiles needed, nor does he need to calculate the multitude of different types of supplemental edgings required to finish the system. The preferred embodiment tile comes complete with all options built-in. In essence, it is a one mat system.

Illustrated in FIG. 3 is an "L" shaped passageway, having a first hallway 81 formed by walls 83 and 85 and an intersecting second hallway 82 formed by walls 84 and 86. In order to begin constructing runner mat, the installer would center tile 50 in hallway 81, then he would note the distance between beveled edge 51 of tile 50 and wall 85. The installer would then move tile 50 toward wall 84 until beveled edge 52 was exactly the same distance from wall 84. Once this is accomplished the installed has established the anchor tile for the rest of the project, without any consideration for the placement of branch tiles for doorways or other intersecting passageways. Once tile 50 is in position the installer simply interlocks subsequent tiles, such as tile 60 and tile 70, into place.

Figure 4:
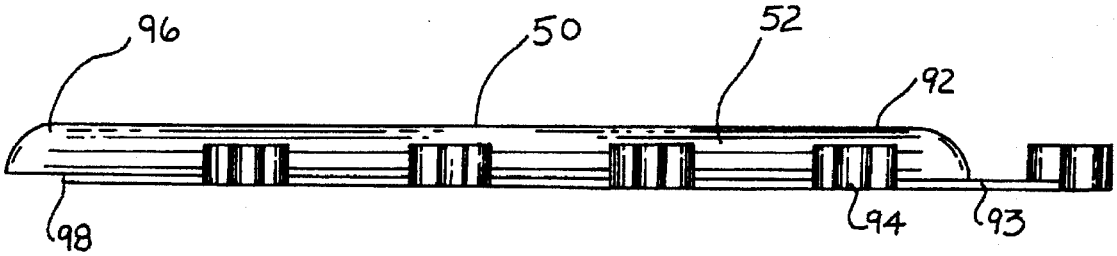
FIG. 4 is a elevational side view of the floor tile of FIG. 3, taken along line 4—4 in FIG. 3.
Figure 5:
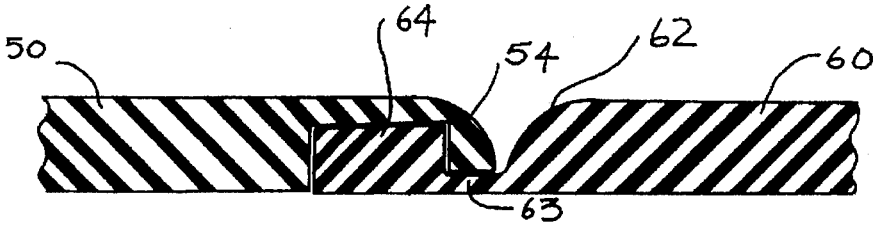
FIG. 5 is a partial cross sectional view taken along line 5—5 in FIG. 3.

Turning now to FIGS. 4 and 5. In FIG. 4, there is illustrated an end view of tile 50 showing the interlocking system. Tile 50 is a rectangular tile constructed of a blend of rubber compounds and which is about 10 mm thick. The edge shown in FIG. 4 is the left-hand beveled edge 52 of tile 50 shown in FIG. 3. Beveled edge 52 has a been beveled with an outside radius of 9.5 and it begins at top surface 92 and slopes downward toward strip 93. Strip 93 is 1.5 mm thick and it is integrally formed with beveled edge 52. Strip 93 extends outward from beveled edge 52 about 15 mm including the male connecting member 94. The function of strip 93 is provide support for a plurality of male support members and to extend the reach of mat 50 under the edge 62 of tile 60, as shown in FIG. 5.

In FIG. 3 it can be seen that strip 93 has short portion which extends almost the entire width of edge 15. Shown in FIG. 3, however, at the left end 96 of edge 15, strip terminates at point 98, which is about 15 mm from edge 21. The reason for this is a space must be left to accommodate the interlocking strip from the next mat. It should also be noted that a male member must be distanced from a beveled edge so as to allow a space to accommodate the beveled edge of a neighboring tile. This is clearly illustrated in FIG. 5. Beveled edge 54 from tile 50 is resting on strip 63 and is fitted between male member 64 and beveled edge 62 of neighboring tile 60.

Once an installer has constructed the runner mat, the branches into doorways or other intersecting runners must be assembled. An example of such a branch is illustrated in FIG. 3. In order to enter through doorway opening 87, the installer places a tile 70 on the appropriate set of interlocking male members of tiles 50 and 60 that best centers tile 70 in opening 87. It is important to note that the preferred embodiment can be installed at any point along runner mat, even across a seam between two tiles. Since the male members are at intervals of 29 mm from center to center the amount of misalignment to doorway opening 87 is minimal. At most tile 70 would be about 15 mm or one-half inch off center, which is far less than any prior art system, such as the one in the Dupont patent.

Upon completion of the system of passageway runners and the branches the installer needs to finish all edges of the mats by adjusting the lengths of the interlocking strips to only those that are necessary. This easily accomplished by removing any of the male interlocking strips which remain unused and exposed. For example, in FIG. 3 short portion 53 of tile 50 is an excess interlocking strip. By using a common utility knife with a heavy duty blade the installer would cut away the strip at the base of beveled edge 52, beginning at point 98 and continuing through to point 100. Likewise, long portion 54 would be removed beginning at point 100 and cutting to point 104. Finally, a small cut needs to be made across the width of portion 54 from point 104 to the outside edge of long portion 54. In this manner the lenght and position of the interlocking strips are adjusted to a minimal size, leaving tile 50 with a safe and finished edge. This result may be seen at the intersection of tile 60 and tile 70. Edge 64 of tile 60 and edge 72 of tile 70 have both been finished to produce a right angle corner that is virtually identical in appearance with an intersection of two tiles that did not have interlocking strips.

While the adjustable interlock floor tile described herein is one embodiment of this invention, this invention is not limited to that particular arrangement and, as will be appreciated and understood by those skilled in the art, changes may be made therein without departing from the scope of the invention which is defined in the appended claims.

I claim:

1. An interlocking tile for forming a walking surface, having an adjustable interlock, comprising:

a. a top surface with four sides and a bottom surface;

b. each of said sides having a downwardly sloping edge, inclining outwardly from said top surface to said bottom surface;

c. at least one of said sides having an intergral strip which extends outwardly from said side, said strip supporting a plurality of male connecting members and constructed to be severable at any point from said downwardly sloping edge; and, d. at least one of said sides having a plurality of cavities, which are located adjacent to said side and facing downward from said top surface, said cavities being positioned to mate with any male connecting member of any other like tile.

2. An interlocking tile for forming a walking surface, having an adjustable interlock, comprising:

a. a top surface with four sides and a bottom surface;

b. each of said sides having a downwardly sloping edge, inclining outwardly from said top surface to said bottom surface;

c. a male connecting means for connecting two adjacent tiles together in the form of integral strip which extends outwardly from said sloping edge of two adjacent said sides, said strip supporting a plurality of male connecting members and constructed to be severable from said sloping edge at any point along said sloping edge; and, d. a corresponding female connecting means in the form of a plurality of cavities, facing downward from said top surface and located adjacent to at least one said sloping sides, each of said cavities being positioned to mate with any male connecting member of any other like tile.

3. A method of constructing a walking surface comprising the steps of:

selecting a floor tile with four sides, a top surface and a bottom surface, said sides having downwardly sloping edges inclining from said top surface to said bottom surface and at least one of said edges having been extended outwardly from said tile to form an interlocking strip having a plurality of male connecting members and at least one of said sides being formed with a plurality of cavities located adjacent to said side and which cavities are positioned to mate with any connecting male member of any like tile;

interlocking said male connecting members and cavities of said tile with the male connecting members and the cavities of other like tiles until a complete floor covering is formed; and, severing any unused interlocking strips from said tiles so as to produce a complete floor covering with only sloping edges on its perimeter.

* * * * *